United States Patent [19]

Rodum

[11] Patent Number: 5,061,021

[45] Date of Patent: Oct. 29, 1991

[54] FLAT FILE

[76] Inventor: Roland K. Rodum, 2870 Cobb St., NE., Marietta, Ga. 30068

[21] Appl. No.: 575,194

[22] Filed: Aug. 30, 1990

Related U.S. Application Data

[63] Continuation of Ser. No. 359,977, Jun. 1, 1989, abandoned.

[51] Int. Cl.[5] ..... A47B 88/00

[52] U.S. Cl. ..... 312/231; 312/311

[58] Field of Search ..... 312/311, 231

[56] References Cited

U.S. PATENT DOCUMENTS

| | | | |
|---|---|---|---|
| 771,995 | 10/1904 | Myers | 312/231 |
| 839,201 | 12/1906 | Richter | 312/231 X |
| 1,244,609 | 10/1917 | Hood et al. | 312/350 X |
| 2,564,283 | 8/1951 | Schallert | 40/65 |
| 2,707,666 | 5/1955 | Becker | 312/223 |
| 3,051,539 | 8/1962 | Montgomery | 312/231 |
| 3,290,106 | 12/1966 | Wilson et al. | 312/222 |
| 3,586,410 | 6/1971 | Barrow | 312/323 |
| 3,666,169 | 5/1972 | Eaton | 312/297 X |
| 4,095,861 | 6/1978 | Kachidurian | 312/350 X |
| 4,502,741 | 3/1985 | DeVries et al. | 312/350 X |
| 4,596,195 | 6/1986 | Wenger | 312/350 X |

*Primary Examiner*—Joseph Falk

*Attorney, Agent, or Firm*—Louis T. Isaf

[57] ABSTRACT

A flat file for storing drawings, providing an easy way to pull a drawing from the middle of a stack of drawings without disrupting the previous order of the stack. A movable board mechanism allows one to lift the drawings stacked on top of a selected drawing and hold them while the selected drawing is retrieved. Later the drawing can be replaced under the board mechanism and the stack returned to its original order.

11 Claims, 3 Drawing Sheets

FLAT FILE

RELATED APPLICATIONS

This application is a continuation of U.S. patent application Ser. No. 07/359,977, filed on June 1, 1989, now abandoned.

BACKGROUND OF THE INVENTION

In forty years of experience in the technical community, this inventor has seen a revolution in the drafting medium of choice for inking from tracing cloth to mylar. While mylar has great linear stability and virtual indestructibility, it nevertheless has inherent problems which have never been addressed in the design of flat files, to wit: being a dense, heavy material, with a very low surface friction, it is extremely mobile in the file drawer, and this weight and mobility make refiling drawings in the proper order very daunting and unrewarding, since it is an awkward process, and any amount of care is undone the very next time a drawing is removed from the stack. As one drawing is removed from the middle of the stack, others tend to stick to it and the whole stack has to be realigned before a new drawing can be located. A new approach to the drawer principle, which is basically still a sound idea, is needed to circumvent these problems.

SUMMARY OF THE INVENTION

Briefly described, the present invention is a flat file comprising a cabinet, tailored to closely fit one specific size drawing. A stack of drawings will ordinarily be stored in the lower portion of the cabinet. The file includes a board approximately half way up in the cavity, which can be interposed at a point in the stack where a desired drawing is located. This is done by manually raising the overlying drawings to facilitate entry of the board. The board is inserted under these drawings and the desired drawing, beneath the board, is then easily retrieved. After replacing it under the board, withdrawing the board allows the stack to recombine by gravity to its original condition.

The basic embodiment for an individual file is a box with a rigid board mounted on full-extension drawer slides. Unfortunately, as the board size increases, the reach across the board when it is withdrawn from the box in order to access the file becomes increasingly onerous. One preferred embodiment of the present invention addresses this problem by adding a "lag panel" which, through a mechanical linkage to the box itself, retracts into a cavity inside the board as the board is pulled out. Since this cavity must degrade the beam strength of the board somewhat, the effect is minimized in preferred embodiments by making the lag panel as wide as possible, so that its beam strength, rather than that of the board, can be relied on for rigidity.

It is therefore an object of the present invention to provide a flat file which functions to lift part of a stack of drawings in the file and hold them suspended above the drawings below while a drawing is either removed from or inserted on the top of the underlying stack of drawings.

Another object of the present invention is to also provide a flat file which allows easy access to any drawing in the file without disrupting the order of the drawings.

Yet another object of the present invention is to provide a flat file with a sliding board assembly having a retractable panel therein for reducing the effective width of the board assembly.

Other objects, features, and advantages of the present invention will become apparent upon reading and understanding of this specification, taken in conjunction with the accompanying drawings.

DETAILED DESCRIPTION

Figure 1:
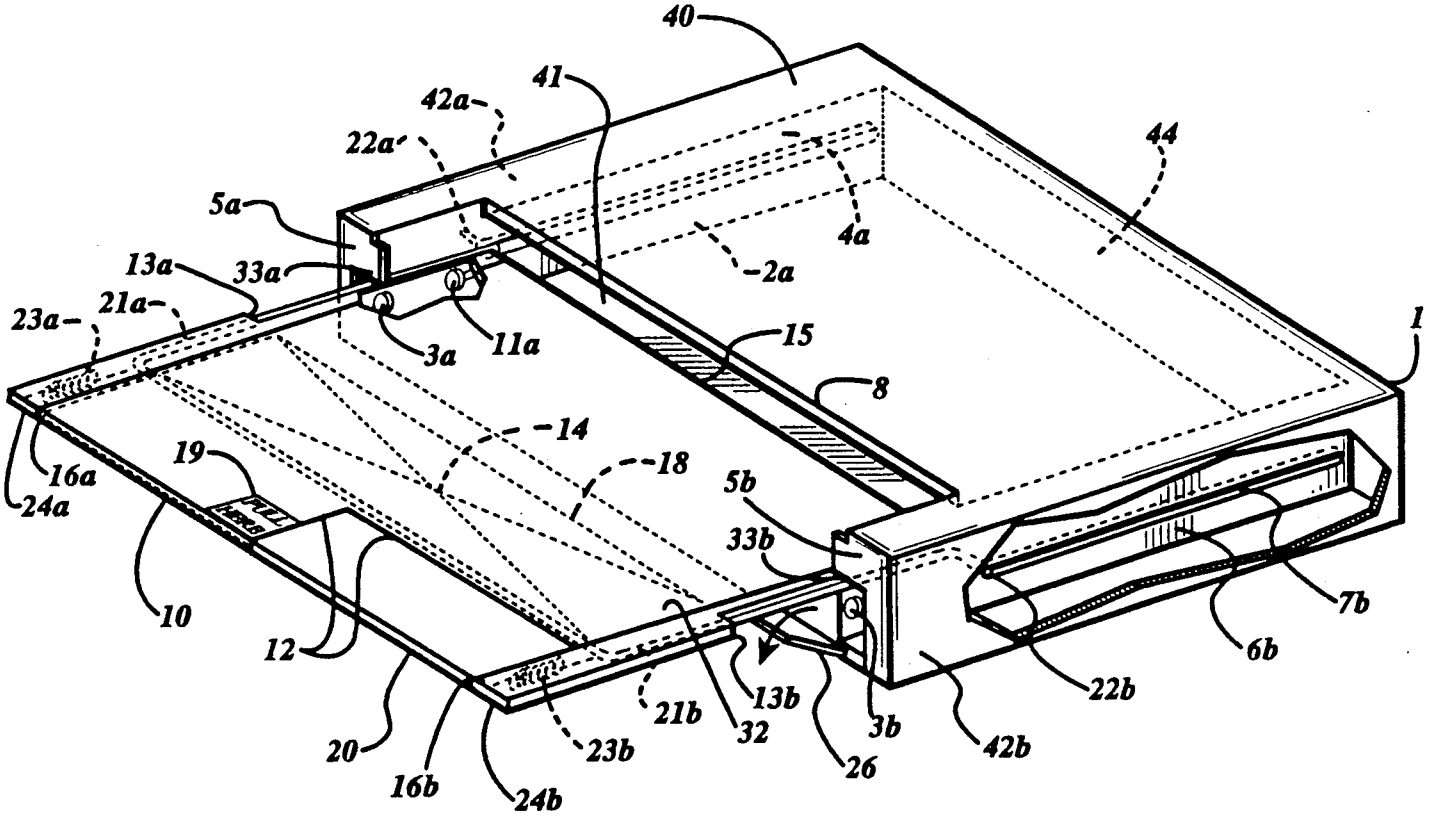
FIG. 1 is a pictorial view for a flat file in accord with the present invention, showing one embodiment thereof.
Figure 2:
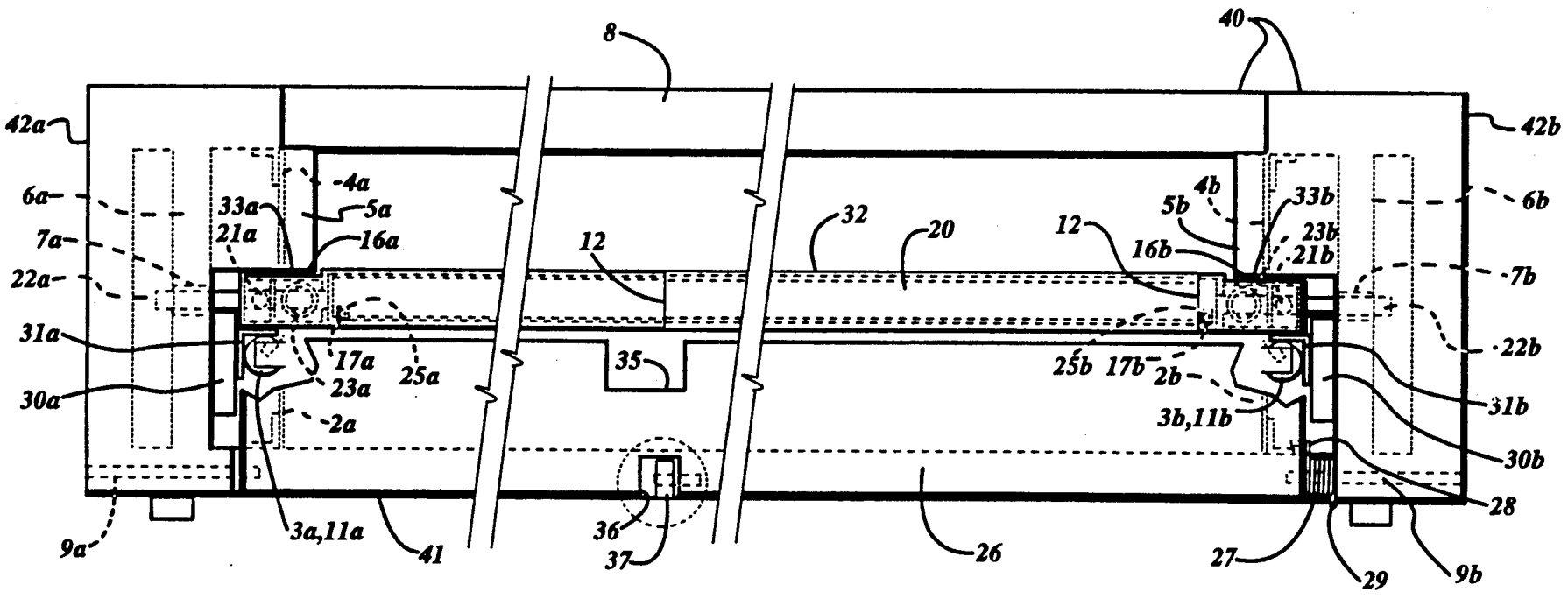
FIG. 2 is a frontal elevation of the file of FIG. 1, with the gate below the board shown only in part.

Referring now in greater detail to the drawings, in which like numerals represent like components throughout the several views, a preferred embodiment of the file of the present invention is seen in FIG. 1 and FIG. 2 as including a box or cabinet 1, open at the front, and having fixed panels at the top 40, bottom 41, left side 42*a*, right side 42*b*, and back side 44. Interior side panels 6*a* and 6*b* are attached to the top 40, bottom 41, and back 44, parallel to side panels 42*a* and 42*b* respectively.

The cabinet 1 is open on the front, as shown in the illustrated embodiment, to allow a board 10 to be alternately inserted or withdrawn from the cabinet 1. A cutout area 8 at the front of the top 40 facilitates access to the file interior. Keepers 5*a*, 5*b* are attached to the front of sides 42*a*, 42*b* above the board 10, and serve to decrease the size of the opening at the front of the cabinet 1. A slight thinning 16*a*, 16*b* at the left and right edges of the board 10 allow the lower edges 33*a*, 33*b* of the keepers 5*a*, 5*b* to barely break below the plane of the board 10. Due to this thinning 16*a*, 16*b* of the board edges, the keepers 5*a*, 5*b* serve to hold drawings that are on top of the board 10 inside the cabinet as the board 10 is removed from the cabinet.

Lower cavity panels 2*a*, 2*b* below the plane of the board 10, and upper cavity panels 4*a*, 4*b* above the plane of the board 10, extend front to rear of the cabinet and define the file cavity width. Cantilevered from the front end of each upper cavity panel 4*a*, 4*b* is a magnet 3*a*, 3*b*.

Figure 8:
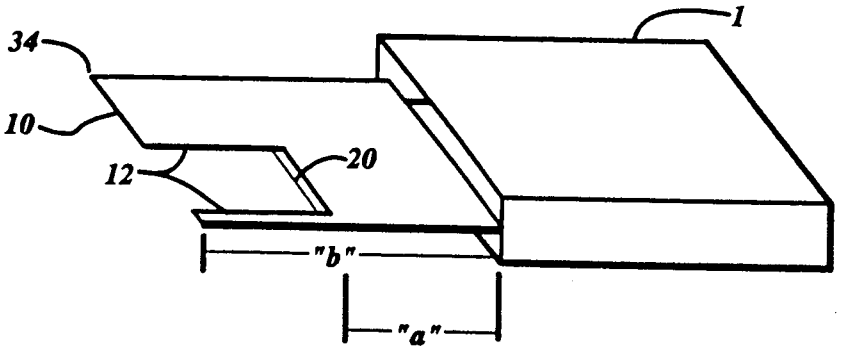
FIG. 8 is a pictorial view of one embodiment of the present invention with the board fully withdrawn and the lag panel fully retracted.

The board 10 is a built-up structure and is provided with an internal lag panel 20. An unbroken recess 14 accommodates the internal lag panel 20 in the interior of the board 10. The lag panel is freely movable from front to back of the board within this space and is guided by rails 17*a*, 17*b* extending from the front 24 to the rear 18 of the lag panel recess 14. At each side of the rear edge 15 of the board 10 and cantilevered out as shown in FIG. 2 are magnets 11*a*, 11*b* so located as to engage the matching aforementioned magnets 3*a*, 3*b* when board 10 is fully withdrawn from the cabinet (Ref. 34, FIG. 8). The rear edge 15 of board 10 is tapered (see FIG. 5).

On each rear side of board 10 is a stepped-in opening 13*a*, 13*b* and the board width is narrower from the openings 13*a*, 13*b* to the rear edge 15 of the board 10. Full extension drawer slides 30*a*, 30*b* mount on the fixed side to internal bulkhead 6*a*, 6*b* and on the sliding side to a bracket 31*a*, 31*b* which in turn mount the board 10.

Lag panel 20, as denoted by the cross-hatch in FIG. 2, has built-in saddles 25*a*, 25*b*, which guide it on rails 17*a*, 17*b* of the board. An L-shaped link 21*a*, 21*b* is rigidly attached to each rear corner of the lag panel and these links extend out through the stepped-in side openings 13*a*, 13*b* in the board (see FIG. 1). The interior side panels 6*a*, 6*b* each have an elongated hole or channel 7*a*, 7*b* for most of their length, and a flared end section 22*a*, 22*b* at the free end of each link 21*a*, 21*b* projects through the elongated opening 7*a*, 7*b* in each respective interior side panel 6*a*, 6*b*. A limber spring 23*a*, 23*b* (capable of doubling its extension) attaches each link 21*a*, 21*b* to the inner surface of the front board facia 24*a*, 24*b*.

Figure 3:
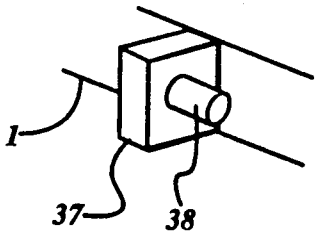
FIG. 3 is a detail of a center hinge boss for the gate of the flat file of FIG. 1, in accordance with one embodiment.
Figure 5:
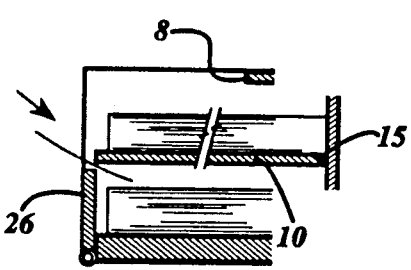
FIGS. 4 and 5 are cross-sectional details of the file of FIG. 1, demonstrating technique in removal and return of a drawing.

Gate 26 (shown ajar in FIG. 1) is shown closed in FIG. 5. It is represented by the fine crosshatch symbol in FIG. 2 showing a preferred embodiment. A drop 35 in its upper edge, adjacent to the "Pull Here" applique 19, allows for an easy thumb hold when gripping the board 10. A center hinge boss 37 (FIG. 3) supports a hinge pin 38 for mounting the gate 26. An oversized cutout 36 at the lower edge of the gate 26 facilitates assembly on the center hinge 37 while hinge pin 9 provides end support. A light-weight spring 27 (one side only) is adequate to provide closure, with its upper extremity 28 embedded in the end surface of the gate 26, and its lower end 29 bearing against the bottom 41 of the cabinet.

Figure 6:
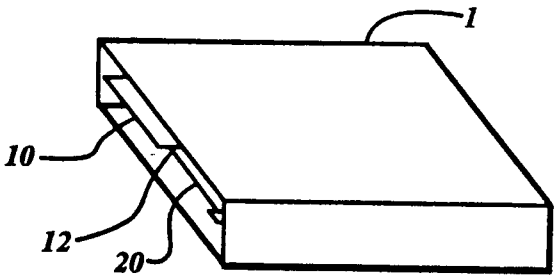
FIG. 6 is a pictorial view of one embodiment of the present invention with the board inside the file.
Figure 7:
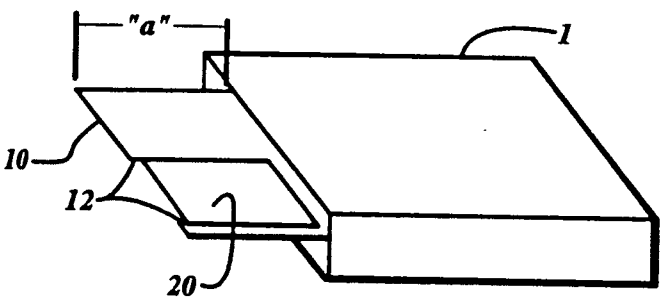
FIG. 7 is a pictorial view of one embodiment of the present invention with the board partially withdrawn and the lag panel fully extended.

In the illustrated embodiment, a rectangular cutout 12, through one front side of the board 10, provides exposure of lag panel 20 (see FIGS. 6–7). As the board 10 is withdrawn from the cabinet a distance "a" (see FIG. 7), the lag panel 20 stays at the front of the board 10. Then, as the board advances between distance "a" and distance "b", (see FIG. 8) the lag panel 20 stays put and the cutout 12 allows closer access to the front of the cabinet 1. The lag panel does not advance with the board as it moves on from distance "a" to distance "b", since the link interface 22*a*, 22*b* reaches the end of channel 7*a*, 7*b* and restrains it from farther advance. Pulling the board 10 out any farther builds potential energy in the springs 23*a*, 23*b* until at the limit of its travel 34 (FIGS. 1, 8), (corresponding with the limit of travel of the drawer slides 30*a*, 30*b*) magnets 3*a*, 3*b* and 11*a*, 11*b* engage, holding the board in the extended position until an inboard impulse breaks the magnetic bond.

The amount of lag shown in FIG. 1 was established by consideration of what would be an acceptable approach distance for the average user. By way of example only, the approach distance is taken arbitrarily to be 18 inches. This results in a lag for a 24×36 inch unit of 6 inches. For the larger unit (e.g. 30×42) the lag panel 20 and its recess 14 would take up proportionately more of the board interior (and make the board cut-out 12 deeper as well). Conversely, for a smaller size (17×22) there would be no lag panel needed. Since this would also eliminate the springs 23*a*, 23*b*, such a unit without a lag panel could have weaker magnets, since their function is thence much reduced.

Figure 4:
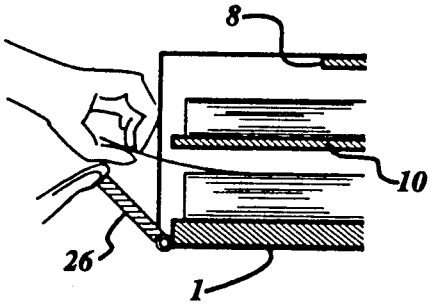

USE: To retrieve a drawing from the file, the user first pulls the board out until the magnetic latch engages. Then, positioning himself at the operator station defined by the board cut-out 12 (FIG. 1), he now has both hands free to reach over and thumb through the file to locate the desired drawing. Lifting the leading edge of the overlying portion of the stack (i.e. that portion overlying the desired drawing) throughout its length well clear of the board's rear edge 15, he applies a sufficient forward pressure to the board 10 with his midriff to break the magnetic bond, allowing the energy released in the springs to propel the board inward under the drawings so elevated. He can now free his left hand to push the board the rest of the way in, while still keeping his grip with the right hand. The inward movement of the board 10 serves to further lift the overlying portion of the stack; and the board supports the overlying portion at a distance above the desired drawing. By the technique in FIG. 4, he now retrieves his desired drawing from its exposed position under the board. When ready to return it to the file, it is slipped into the aperture between the gate and the board (FIG. 5) with enough thrust to propel it completely into the file cavity. Finally, the file is restored to its original condition by pulling the board out, in which process the keepers 5*a*, 5*b* restrain the overlying drawings from moving forward with the board, so the file recombines by gravity. The board can be pushed back in, for storage, above the recombined stack.

Whereas the present invention has been described in detail with specific reference to particular embodiments thereof, it will be understood that variations and modifications can be affected within the spirit and scope of the present invention as hereinbefore described and as defined in the appended claims.

I claim:

1. A flat file for storing drawings, comprising:

a box-like cabinet having a top panel and a bottom panel, two side panels, and a rear panel, said top panel and said bottom panel being larger in size than the drawings to be stored within said cabinet;

a board suitably mounted at a first position within said cabinet from which position said board can be moved to a second position substantially outside of said cabinet;

said board including, at least, a top surface and linear indentations defined in said top surface running from the front to the back of said board, parallel to said cabinet side panels;

keeper means, mounted to said cabinet above said board and extending into said linear indentations, for keeping any drawings stacked on top of said board within said cabinet as said board is moved from the first position to the second position; and a gate at the front of said cabinet, below the plane of the board, that can be opened to allow drawings to be inserted into or removed from said cabinet below said board.

2. Flat file of claim 1, further comprising, at least, retention means for holding said board at said second position.

3. A flat file for storing drawings, comprising:

a box-like cabinet comprising, at least, a bottom panel, two side panels, and a rear panel, said bottom panel being larger in size than the drawings to be stored within said cabinet;

a board slidably mounted at a first position within said cabinet from which position said board can be moved to a second position substantially outside of said cabinet, said board having a front edge, a back edge and a hollow interior defining a cavity within said board, said cavity having a front end and a back end, said front end of said cavity being adjacent said front edge of said board;

a lag panel slidably mounted within said cavity, said lag panel having a depth that is substantially less than the depth of said cavity; and an operator access area cut into the front edge of said board, communicating between the exterior of said board and said cavity, said operator access area having a depth nearly equal to the depth of said lag panel and a width less than the lag panel width, wherein said operator access area is occupied by said lag panel when said lag panel is adjacent the front end of said cavity and said operator access area is unobstructed by said lag panel when said lag panel is adjacent the rear end of said cavity.

4. Flat file of claim 3, further comprising, at least, biasing means for biasing said lag panel toward the front edge of said board.

5. Flat file of claim 3, further comprising, at least, retention means for holding said board at said second position.

6. Flat file of claim 3, further comprising, at least, biasing means for biasing said lag panel toward the front edge of said board and retention means for holding said board at said second position.

7. A flat file for storing drawings, comprising:

a box-like cabinet comprising, at least, a top panel and a bottom panel, two side panels, and a rear panel;

a board slidably mounted at a first position within said cabinet from which position said board can be moved to a second position substantially outside of said cabinet;

said board including, at least, a top surface and linear indentations defined in said top surface running from the front to the back of said board, parallel to said cabinet side panels;

keeper means, mounted to said cabinet above said board and extending into said linear indentations, for keeping any drawings stacked on top of said board within said cabinet as said board is moved from the first position to the second position;

a gate at the front of said cabinet, below the plane of the board, that can be opened to allow a drawing to be removed from said cabinet below said board;

said board further comprising a hollow interior defining a cavity within said board, said cavity having a front end and a back end, said front end of said cavity being adjacent said front edge of said board;

a lag panel slidably mounted within said cavity, said lag panel having a depth substantially less than the depth of said cavity;

an operator access area cut into the front edge of said board, communicating between the exterior of said board and said cavity, said operator access area having a depth nearly equal to but less than the depth of said lag panel and a width less than said lag panel width; and retracting means for moving said lag panel from a position adjacent the front end of said cavity, where said lag panel occupies said operator access area, to a position adjacent the rear end of said cavity, where said operator access area is unobstructed by said lag panel, said retracting means operably engaged by moving said board from the first position to the second position.

8. Flat file of claim 7, further comprising, at least, biasing means for biasing said lag panel toward the front of said board.

9. Flat file of claim 7, further comprising, at least, retention means for holding said board at said second position.

10. Flat file of claim 7, further comprising, at least, biasing means for biasing said lag panel toward the front of said board and retention means for holding said board at said second position.

11. A flat file for storing drawings, comprising:

a box-like cabinet having a top panel and a bottom panel, two side panels, and a rear panel, said top panel and said bottom panel being larger in size than the drawings to be stored within said cabinet;

a board slidably mounted at a first position within said cabinet from which position said board can be moved to a second position substantially outside of said cabinet;

said board including, at least, a top surface and linear indentations defined in said top surface running from the front to the back of said board, parallel to said cabinet side panels;

keeper means cooperating with said indentations for keeping any drawings stacked on top of said board within said cabinet as said board is moved from the first position to the second position;

a gate at the front of said cabinet, below the plane of the board, that can be opened to allow drawings to be inserted into or removed from said cabinet below said board;

a cavity within said board;

a lag panel slidably mounted within said cavity, said lag panel having a width substantially equal to the width of said board and a depth that is substantially less than the depth of said board;

a lag panel access area cut into one front edge of said board, said lag panel access area having a depth nearly equal to the depth of said lag panel and a width at least half as wide as the lag panel width; and retracting means for moving said lag panel from a position at the front of said cavity, filling said lag panel access area, to a position at the rear of said cavity, leaving said lag panel access area clear, said retracting means operably engaged by withdrawal of said board from said cabinet.

* * * * *